US009801779B2

(12) United States Patent
Breibart et al.

(10) Patent No.: US 9,801,779 B2
(45) Date of Patent: Oct. 31, 2017

(54) PROPRIOCEPTIVE FEEDBACK ASSIST DEVICE AND ASSOCIATED METHOD

(71) Applicant: Directives, LLC, New York, NY (US)

(72) Inventors: Joan Breibart, New York, NY (US); Marika Molnar, Carmel, NY (US)

(73) Assignee: PHYSICALMIND INC., New York, NY (US)

( * ) Notice: Subject to any disclaimer, the term of this patent is extended or adjusted under 35 U.S.C. 154(b) by 0 days.

(21) Appl. No.: 14/837,740

(22) Filed: Aug. 27, 2015

(65) Prior Publication Data

US 2016/0059063 A1 Mar. 3, 2016

Related U.S. Application Data

(60) Provisional application No. 62/045,309, filed on Sep. 3, 2014.

(51) Int. Cl.
*A63B 21/02* (2006.01)
*A61H 7/00* (2006.01)
(Continued)

(52) U.S. Cl.
CPC ..... *A61H 7/001* (2013.01); *A63B 21/065* (2013.01); *A63B 21/4007* (2015.10);
(Continued)

(58) Field of Classification Search
CPC ..... A61H 7/001; A61H 2201/1284; A61H 2201/1623; A61H 2205/081; A61H 1/008; A61H 1/0092; A61H 1/0292; A61H 1/0296; A63B 23/185; A63B 23/0244; A63B 23/025; A63B 23/0238; A63B 21/065; A63B 21/068; A63B 21/4009; A63B 21/4007; A63B 21/4013; A63B 21/028;
(Continued)

(56) References Cited

U.S. PATENT DOCUMENTS 5,026,736 A * 6/1991 Pontiff ..... B29B 9/06 521/182
6,560,932 B2 5/2003 Heroux
(Continued)

OTHER PUBLICATIONS

Yuke Miyake et al., The Effect of Trunk Coordination Exercise on Dynamic Postural Control Using a Core Noodle, Journal of Bodywork and Movement Therapies, Oct. 2014vol. 18, Issue 4, pp. 519-525.
Website: http://mywellnessia.com/topics/?page_id=2269. As early as May 5, 2015.
(Continued)

*Primary Examiner* — Loan H Thanh
*Assistant Examiner* — Megan Anderson
(74) *Attorney, Agent, or Firm* — R. Neil Sudol; Henry D. Coleman

(57) ABSTRACT

A device for facilitating or enhancing proprioceptive feedback during breathing and related exercises includes a user attachment component attachable to a user about the thorax. Two elongate tensile members are connected at proximal ends to the user attachment component at points essentially just below the armpits of a user. These two elongate tensile members are connectable at their distal ends to the feet of the user. Another two tensile members are connected at their proximal ends to a back portion or strap of the harness and at their distal ends to or about the user's hands.

8 Claims, 7 Drawing Sheets

(51) Int. Cl.

| | |
|---|---|
| ***A63B 21/065*** | (2006.01) |
| ***A63B 23/18*** | (2006.01) |
| *A63B 21/068* | (2006.01) |
| *A63B 23/02* | (2006.01) |
| *A63B 23/025* | (2006.01) |
| *A63B 21/00* | (2006.01) |
| *A63B 26/00* | (2006.01) |

(52) U.S. Cl.
CPC ..... *A63B 21/4009* (2015.10); *A63B 23/185* (2013.01); *A61H 2201/1284* (2013.01); *A61H 2201/1623* (2013.01); *A61H 2205/081* (2013.01); *A63B 21/028* (2013.01); *A63B 21/068* (2013.01); *A63B 21/4013* (2015.10); *A63B 23/025* (2013.01); *A63B 23/0244* (2013.01); *A63B 26/003* (2013.01); *A63B 2208/0233* (2013.01); *A63B 2208/0252* (2013.01); *A63B 2209/10* (2013.01)

(58) Field of Classification Search
CPC ..... A63B 21/0244; A63B 21/025; A63B 21/4003; A63B 21/4039; A63B 26/003; A63B 2208/0233; A63B 2208/0252; A63B 2209/10
See application file for complete search history.

(56) References Cited

U.S. PATENT DOCUMENTS

| | | | | |
|---|---|---|---|---|
| 7,060,085 | B2 * | 6/2006 | Graham | A61H 1/0218 128/845 |
| 7,854,695 | B2 * | 12/2010 | Lightbourne | A61H 1/0292 482/142 |
| 8,088,084 | B2 * | 1/2012 | Zahos | A61H 23/0245 600/437 |
| 8,252,024 | B2 * | 8/2012 | Bax | A61H 1/0292 5/630 |
| 9,241,820 | B2 * | 1/2016 | Graham | A61F 5/01 |
| 2007/0276438 | A1 * | 11/2007 | Meglin | A61H 1/0292 606/237 |
| 2008/0200853 | A1 * | 8/2008 | Tielye | A61H 1/0292 601/134 |
| 2010/0236560 | A1 * | 9/2010 | Rambo | A61F 5/01 128/845 |
| 2012/0179201 | A1 * | 7/2012 | Segur | A61H 1/008 606/237 |
| 2014/0276280 | A1 * | 9/2014 | Oller, Jr. | A61H 7/003 601/138 |

OTHER PUBLICATIONS

ADMIN: http://mywellnessia.com/, The Innerworks of the SmartSpine System Explained. Aug. 21, 2014.

* cited by examiner

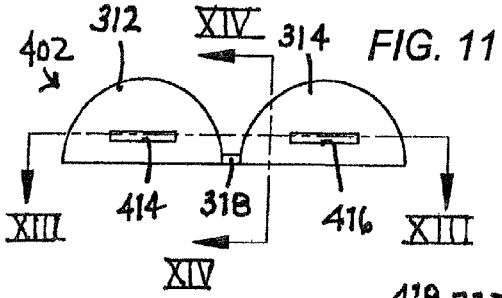
FIG. 11
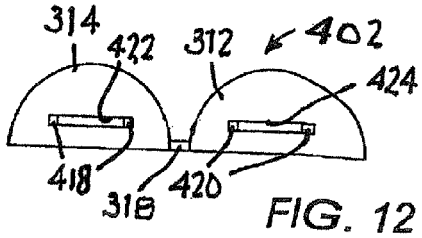
FIG. 12
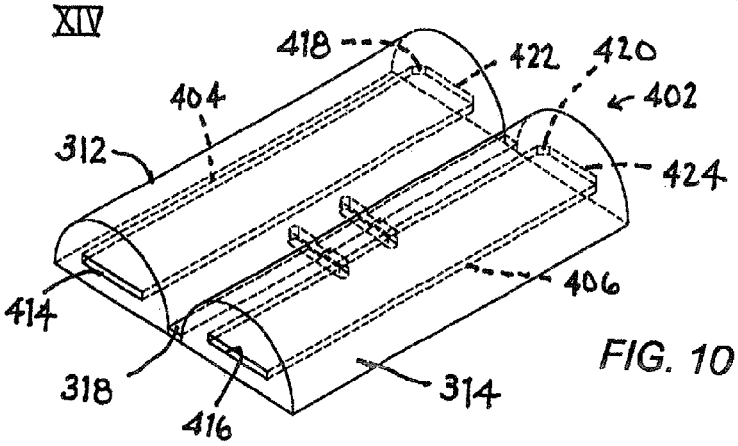
FIG. 10
FIG. 13
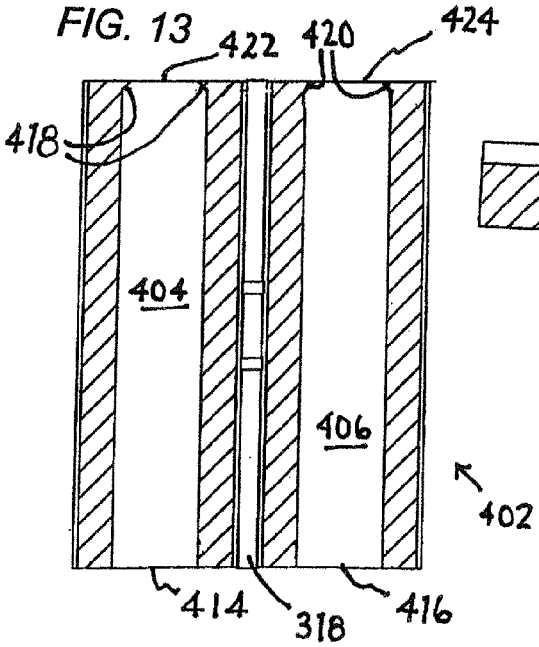
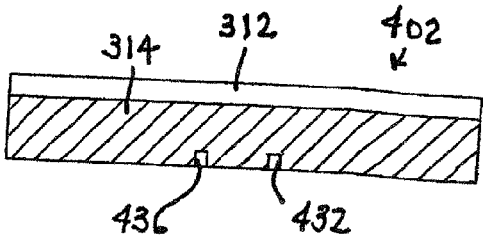
FIG. 14

FIG. 15
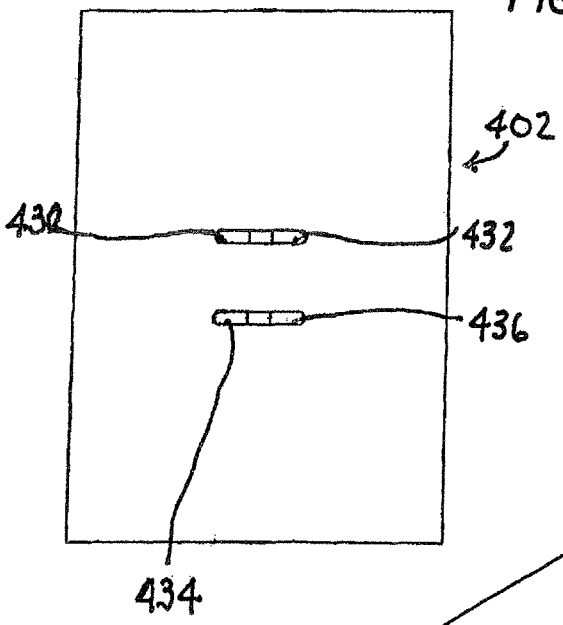
FIG. 16
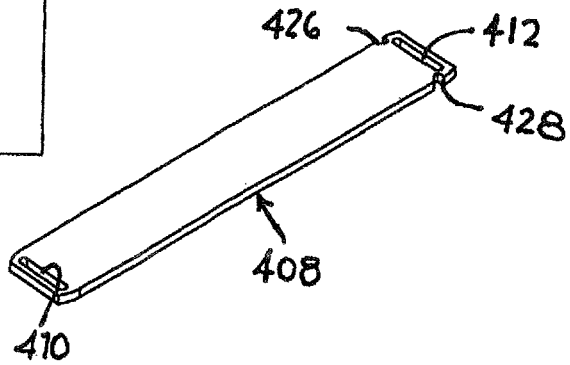
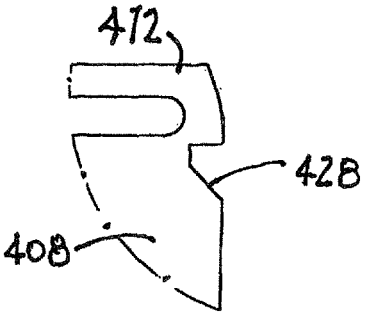
FIG. 18
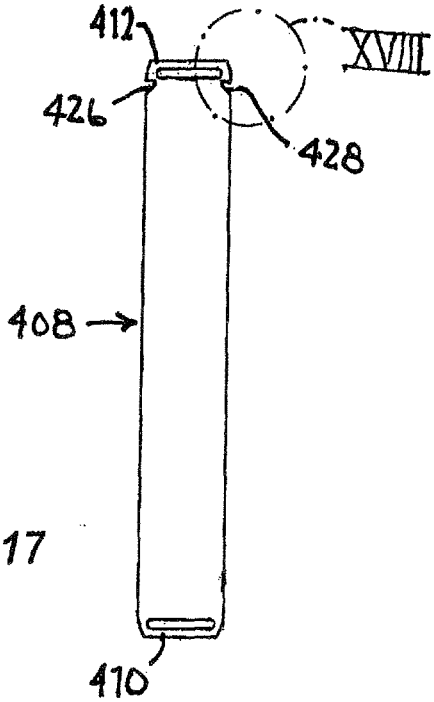
FIG. 17

PROPRIOCEPTIVE FEEDBACK ASSIST DEVICE AND ASSOCIATED METHOD

CROSS-REFERENCE TO RELATED APPLICATION

This application claims the benefit of U.S. Provisional Patent Application No. 62/045,309 filed Sep. 3, 2014.

BACKGROUND OF THE INVENTION

This invention relates to a device for use in facilitating or assisting a user in enhancing proprioception during breathing exercises. This invention also relates to an associated method utilizing the device.

The majority of the U.S. population is obese (55% plus another 20% is overweight) which means that a majority have elevated cortisol levels. In addition, many emotional afflictions find their roots in spinal misalignment and improper nerve stimulation owing to tense back muscles and imbalances from extra weight.

OBJECTS OF THE INVENTION

An object of the present invention is to provide a device for use by an individual during breathing exercises giving a traction like effect from the pressure and stimulation and a massage action to the spine.

A related object of the present invention is to provide such a device that furnishes feedback to the user's ribcage and spine during inspiration and expiration, facilitates a relaxation and recovery effect.

The present invention seeks in part to provide a device and a related spinal massage method that favorably acts on spinal nerves, assists in spinal adjustment and alignment, and has beneficial effects on the parasympathetic nervous system.

These and other objects of the present invention will be apparent to one skilled in the art from the drawings and descriptions herein. Although every feature of the invention is attained in at least one embodiment of the invention, there is not necessarily any one embodiment that achieves all of the objects of the invention.

SUMMARY OF THE INVENTION

A device for facilitating or enhancing proprioceptive feedback particularly during breathing exercises comprises, in accordance with the present invention, two elongate resiliently compressible members so coupled together as to remain in parallel relation during use of the device when positioned against the back of a user. The device further comprises a fastening or coupling element configured for attachment to a user so that the resiliently compressible members are held against the user's back parallel to the user's spine and on opposites thereof.

The device is provided in two main versions, each configured for a respective mode of use. One version is adapted for use in a sitting posture, while the other version is designed for a supine posture.

In the wearable sitting-posture version of the proprioception feedback device, the user attachment element may include a pair of shoulder straps. Alternatively, the user attachment element may take the form of a vest, e.g., a collection of straps that effectively encircle the thorax of the user. In another alternative, the user attachment element may take the form of a strap, band or belt that is fastened about the rib cage or torso of the user, below the breasts or pectoral muscles.

In the supine version of the present device, the user attachment element preferably takes the form of a strap, band or belt (e.g., with releasable VELCRO™ fasteners) that wraps around the torso of the user, especially, about the rib cage below the breasts or pectoral muscles.

Pursuant to another feature of the present invention, the proprioception assist device, particularly the upright or sitting-posture version, may further comprise a flexible elongate tensile member attachable at respective ends in regions about respective hands of the user, for instance, via loops and so coupled directly or indirectly to the resiliently compressible members so as to extend behind or in front or to the sides of the user during use of the device. Where the user attachment element comprises straps, buckles, and flexible cords or ties in an arrangement having a back portion, a front portion and side portions, the resiliently compressible members are connected to the user attachment element or assembly at the back portion thereof. Likewise, the tensile member is coupled to the back portion of the user attachment element.

Pursuant to more particular features of the present invention, the tensile member is slidably attached to the resiliently compressible members or the user attachment element (e.g., via one or more loops) and is at least partially elastic. The tensile member may take the form of a bungee cord or stretchable rubber tubing provided at opposite ends with a pair of loops or handles releasably securable to respective hands of the user.

The resiliently compressible members are preferably made of a foam material and more preferably of a closed cell foam material such as EVA. The cylindrical sections may be cut longitudinally through the center axis so that the resiliently compressible members are semi-cylindrical with a first, cylindrical, outer surface and a second, flat or planar, outer surface contiguous therewith.

The proprioception assist device, whether the upright sitting version or the supine version, may include a pair of slip covers or casings (different from the user attachment elements) that receive the resiliently compressible members, for purposes of providing a more pleasing and warming contact with the user, if a neoprene material or similar fabric is used. Alternatively, a single cover or casing may contain both resiliently compressible members. In that case, the covers or casings may serve in part to hold the resiliently compressible foam members in parallel to one another with space between for spinous process.

A method for facilitating or enhancing proprioceptive feedback comprises, in accordance with the present invention, (i) providing two elongate resiliently compressible members coupled to one another so as to maintain a mutually parallel configuration, (ii) attaching the resiliently compressible members to a user, so that the resiliently compressible members are disposed against the user's back in parallel to the user's spine and on opposite sides of the spine, and (iii) moving the user's back against the resiliently compressible members. Preferably, the resiliently compressible members are positioned at least alongside the thoracic region of the spine. Where the user assumes a sitting posture, the resiliently compressible members are disposed only in contact with the thoracic region of the spine.

Where the user assumes a supine posture (and dons the supine version of the device described above), the compressible members may extend to the head of the user. In that case, a third resiliently compressible member may be provided, attached to one end of the spinal members and extending perpendicularly thereto, for forming a head abutment providing resistance to a rearward pressing of a user's head. This assists the user in applying traction to the spine, particularly if the supine version of the device is provided also with ankle straps.

The movement of the back against the elongate compressible spinal members during use of the device may result naturally from breathing, particularly via an expansion and contraction of the diaphragm and rib cage. The method enables users to bring awareness to the posterior part of the trunk while mobilizing the interior of the body, allowing trunk stabilization and respiration into the posterior rib cage, which stimulates the parasympathetic nervous system. The method and device of the present invention facilitates a cognitive component that can work the brain in tandem with the body.

It is contemplated that the stimulation of the parasympathetic nervous system reduces the concentration of cortisol in the user's body and leads over a long term to weight reduction.

In the wearable or sitting-posture embodiment of the proprioception assist device, the disposing of the resiliently compressible members against the user includes attaching the resiliently compressible members to the user via a body assembly, such as shoulder straps and optionally one or more chest straps or bands. Where the device includes an elongate tensile member (bungee cord or stretchable rubber tubing) coupled to the body assembly, the attaching to the user may include disposing the elongate tensile member on the back side of the user. The method then further comprises attaching ends of the at least one elongate tensile member to the user's hands and exerting tension on the elongate tensile member (e.g., bungee cord, rubber tubing).

During performance of the method, the user may lie on a horizontal surface (reclining position) or a seat back (sitting position). The principal motion of the user's back against the resiliently compressible members arises from the breathing process.

A back massage/stimulation and feedback assist device comprises, in accordance with the present invention, two elongate resiliently compressible members, at least one first coupling element connected to the resiliently compressible members so as to hold the resiliently compressible members in parallel relation to one another and at a predetermined distance from one another (preferably about ¼ inch so that the rollers rest on the ribs and not on the shoulder blades), and at least one second fastening or coupling element for removably attaching the resiliently compressible members to a user. The first coupling member may take the form of one or more straps that are connected (e.g., glued) to the outer surfaces of the resiliently compressible members. Alternatively, the first coupling member may take the form of a casing or envelope that surrounds and encloses the resiliently compressible members. The casing or envelope may have a pair of chambers, one for each of the resiliently compressible members, with the chambers being spaced a predetermined distance (preferably approximately ¼ inch).

The use of two resiliently compressible members in parallel with one another creates an effective spacing enabling the spinous processes of the vertebrae to fit comfortably in between without pressure on them. The resiliently compressible members may engage one another along their lengths, with the protection to the spine being afforded by the tapering cross-sections of the compressible members.

The maximum distance between the resiliently compressible members may be ¼ inch (the distances between the points of maximum thickness or height of the compressible members is naturally greater). The shapes of the resiliently compressible members in that event channel the user's weight (reclining mode) or applied pressure away from the spinal column itself to the supporting musculature on opposite sides of the spine.

The coupling element or elements binding the resiliently compressible members to one another serve to hold the resiliently compressible members together in opposition to a spreading or dislocating force naturally exerted by the user's back during use of the device.

The resiliently compressible members are preferably made of a foam material and have an at least partially cylindrical outer surface. At least one casing or cover may be provided to enclose one or both of the resiliently compressible members.

The proprioception assist device may further comprise a flexible elongate tensile member coupled to the resiliently compressible members and the coupling element for extending behind/in front/to the sides of the user during use of the device, the tensile member being attachable at respective ends in regions about respective hands of the user. The tensile member may include a pair of loops or handgrips releasably securable about respective hands of the user.

A device in accordance with the present invention may be used in massaging the back, particularly the muscles and nerves in the thoracic region, on opposite sides of the spine. Using the device favorably acts on spinal nerves, assists in spinal adjustment and alignment, and has beneficial effects on the parasympathetic nervous system, allowing better relaxation and digestion by reducing stress which in turn reduces cortisol production. The method using the device of the present invention may assist in spinal nerve adjustment, posture correction and/or equilibration of the parasympathetic nervous system.

The device and method of the present invention may be used by an individual in breathing exercises and light-pressure back massage action. The device furnishes feedback to the user's ribcage and spine during inspiration and expiration, which facilitates a coordination of cognitive with the physical body. Moreover, use of the device increases the flow of oxygen through the system and improves the functioning of the trunk muscles. Supine versions of the resiliently compressible members allow trunk support from head to tailbone and the head rest, rib wrap and ankle restraint provide a traction like effect, that magnifies the breathing facilitating a beneficial and pleasurable effect on the parasympathetic nervous system.

The device and method of the present invention may additionally assist in massaging organic tissues located along and adjacent to the spine, improving nerve response and stabilization. A double foam member system provides comfort and support allowing longer and/or more frequent breathing and massage exercise routines, which helps with trunk stabilization and respiration into the posterior rib cage, enhancing oxygen circulation. Frequent use of the device increases the ability of the ribs to expand, allowing more oxygen to enter the lungs and become absorbed onto the blood. In addition, muscles of the pelvic floor are stabilized and the spine is strengthened, protecting the bones and improving alignment. This in turn increases the cognitive coordination of physical performance during functional activities and stimulates healthier posture.

BRIEF DESCRIPTION OF THE DRAWING

FIG. 10 is an isometric view of a body member of the wearable proprioception assist device of FIGS. 8 and 9, showing a particular implementation.

FIG. 11 is an end elevational view of the body member of FIG. 10, taken from the upper right in that figure.

FIG. 12 is an end elevational view of the body member of FIG. 10, taken from the lower left in that figure.

FIG. 13 is a cross-sectional view taken along line XIII-XIII in FIG. 11.

FIG. 14 is a cross-sectional view taken along line XIV-XIIV in FIG. 11.

FIG. 15 is a bottom plan view of the body member of FIGS. 10-14.

FIG. 16 is an isometric view of one of two identical inserts traversing longitudinal slots in the body member of FIGS. 10-15.

FIG. 17 is a top plan view of the insert of FIG. 16.

FIG. 18 is a detail, on a larger scale, of a corner of the insert of FIGS. 16 and 17, encircled at XVIII in FIG. 17.

DETAILED DESCRIPTION

Figure 1:
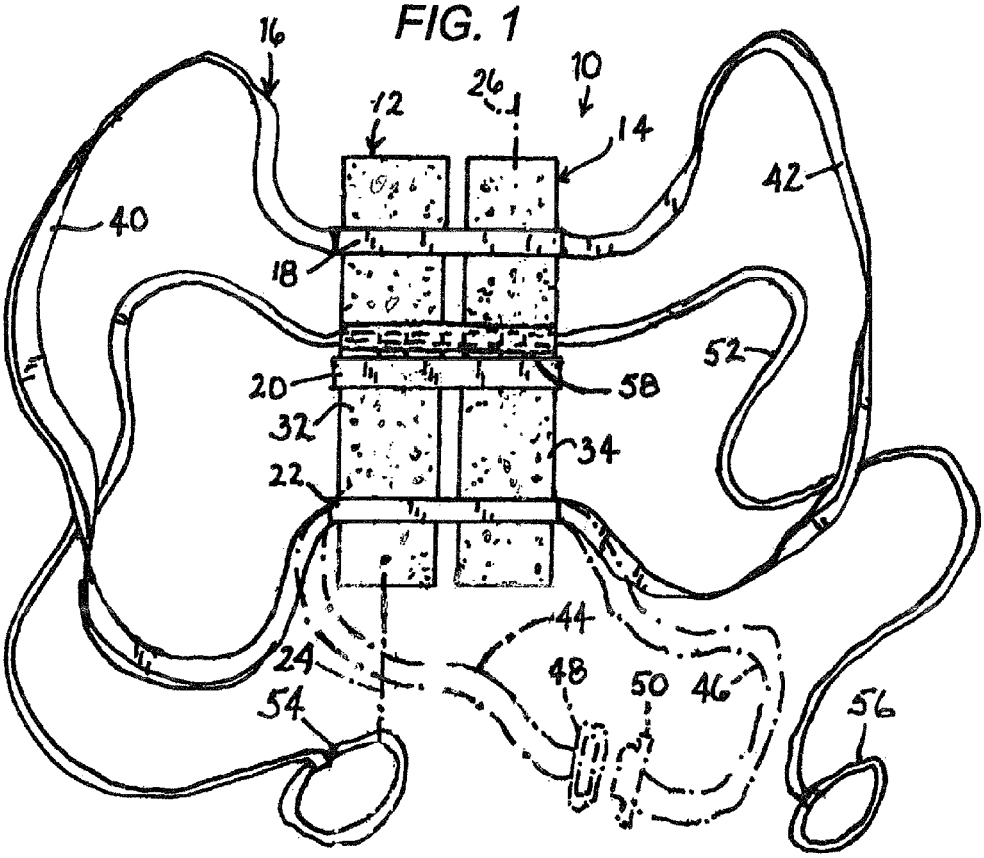
FIG. 1 is a schematic front elevational view of a wearable version of a proprioception assist device in accordance with the present invention, for use particularly in a sitting posture.
Figure 2:
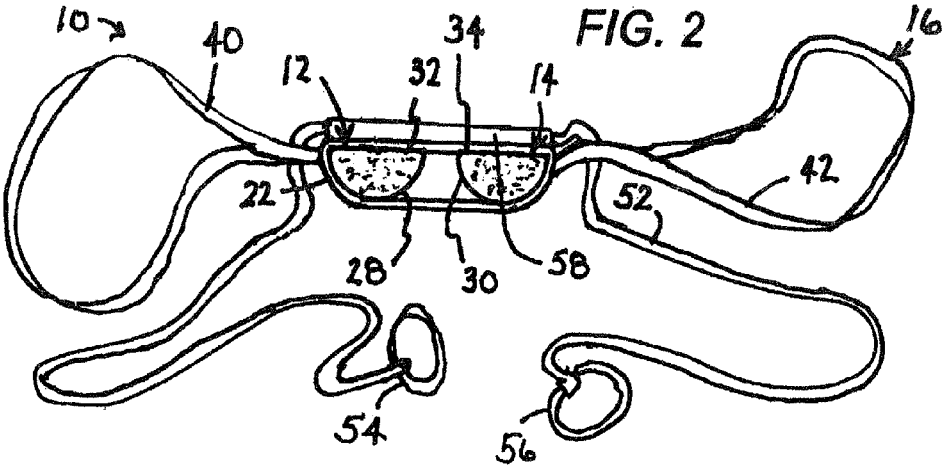
FIG. 2 is a schematic bottom plan view of the device of FIG. 1.

As illustrated in FIGS. 1 and 2, a wearable proprioception assist device 10 particularly for use during breathing exercises in a sitting posture comprises a pair of elongate resiliently compressible members 12 and 14 each approximately 7 inches in length and a fastening assembly 16 including three coupling elements 18, 20 and 22 in the form of thin flexible bands attached to and encircling the resiliently compressible members so as to maintain the resiliently compressible members in parallel relation to one another and at a predetermined maximum spacing, exemplarily about ¼ inch. Coupling bands 18, 20, and 22 may be attached via adhesive to the elongate resiliently compressible members 12 and 14.

Compressible members 12 and 14 are preferably made of a foam material and more preferably of a closed cell foam material such as polyethylene or ethylene vinyl acetate (EVA). Members 12 and 14 are exemplarily half sections of polymeric foam cylinders. In that case the cylindrical sections are cut longitudinally through center axes 24 and 26 so that compressible members 12 and 14 are semi-cylindrical each with a first, cylindrical, outer surface 28 and 30 and a second, flat or planar, outer surface 32 and 34 contiguous therewith. Alternatively, resiliently compressible members 12 and 14 may be manufactured by casting or molding polymeric (PE, EVA) foam material into the final shape, accordingly without use of a preform.

Fastening assembly 16 of wearable proprioception assist device 10 may include user attachment elements such as a pair of shoulder straps 40 and 42 each fastened (e.g., via adhesive or stitching) to coupling bands 18 and 22. Shoulder straps 40 and 42 hold the assist device 10 and particularly compressible members 12 and 14 against the user's back so that the compressible members are parallel to the user's spine—preferably the thoracic region of the spine—and on opposites thereof.

Fastening and user attachment assembly 16 may be optionally provided with componentry, for instance, a pair of belt segments 44 and 46 having cooperating buckle parts 48 and 50, for suitably fixing the assembly about the thorax or torso of the user, with the belt straps buckled to one another across the front of the user's chest. Thus, fastening and user attachment assembly 16 may be configured for positioning and maintaining resiliently compressible members 12 and 14 along the thoracic part of the spinal column thus increasing the effect.

Wearable proprioception assist device 10 optionally further comprises a flexible elongate tensile member 52 such as a bungee cord or stretchable rubber tubing having loops or rings 54 and 56 at opposite ends for coupling the bungee cord (or tubing) to respective hands of the user. Bungee cord 52 is coupled to fastening and user attachment assembly 16 so that the bungee cord extends behind the user's back. As shown in FIGS. 1 and 2, bungee cord 52 may slidably traverse an elongate fabric tube 58 attached to compressible members 12 and 14 along a front or rear side thereof. Tube 58 may be attached to band 20 by glue or stitching and extend therealong transversely to compressible members 12 and 14. (Alternatively, tube 58 may be removably attached to compressible members 12 and 14 exemplarily via VELCRO type hook and loops fasteners or by snap-lock fasteners. This option may be used in other embodiments as well.) Bands 18, 20, and 22 of fastening and user attachment assembly 16 together with opposite end portions of shoulder straps 40 and 42 and proximal end portions of belt segments 44 and 46 constitute a back side of fastening and user attachment assembly 16, while middle portions of shoulder straps 40 and 42 and distal end portions of belt segments 44 and 46, together with buckle parts 48 and 50 constitute left and right sides and a front side of the fastening and user attachment assembly 16.

Figure 3:
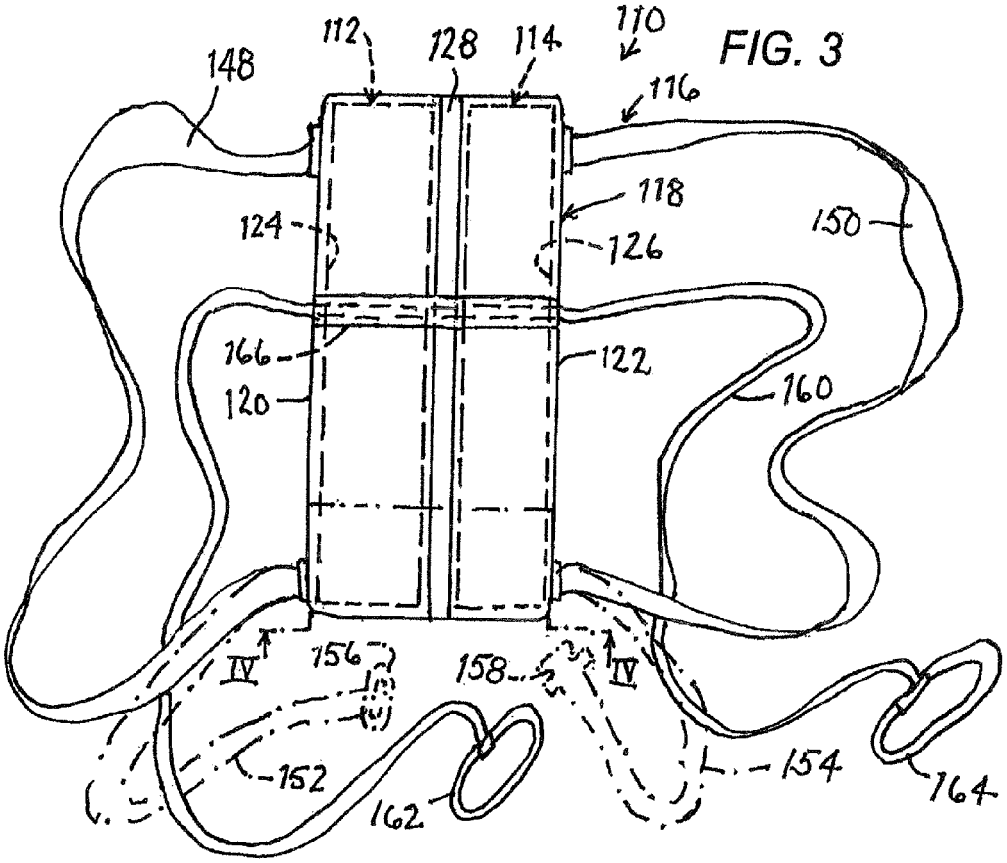
FIG. 3 is a schematic front elevational view of another wearable proprioception assist device in accordance with the present invention, for use in a sitting posture.
Figure 4:
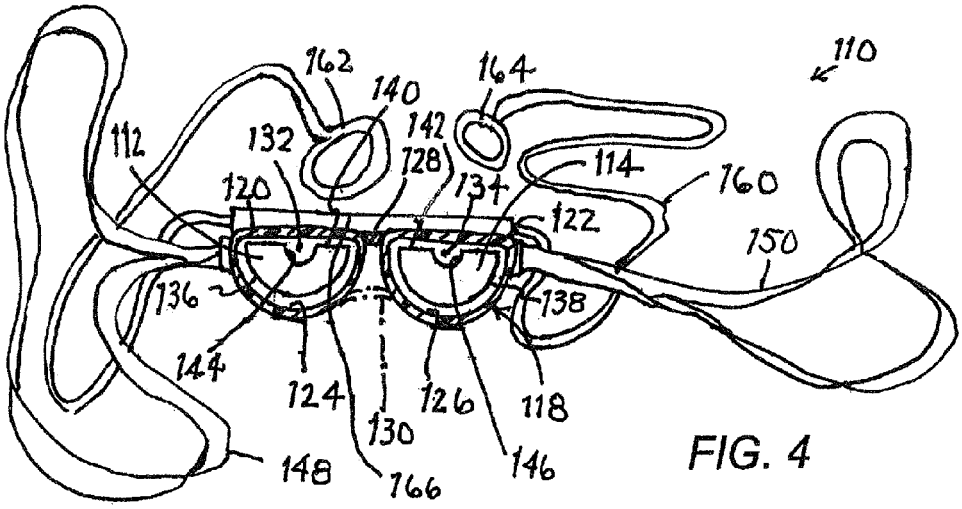
FIG. 4 is a schematic bottom plan view, partially taken in section along line IV-IV, of the device of FIG. 3.

As depicted in FIGS. 3 and 4, another wearable proprioception assist device 110 also particularly for use during breathing exercises in a sitting posture comprises a pair of elongate resiliently compressible members 112 and 114 each approximately 7 inches in length and a fastening and user attachment assembly 116 which in turn comprises a slip cover assembly 118 including a pair of fabric casings or bags 120 and 122 defining a pair of chambers 124 and 126 that receive and enclose respective compressible members 112 and 114 and maintain the resiliently compressible members in parallel relation to, and at a maximal distance from, one another. Casings or bags 120 and 122 are connected to one another by one or more fabric strips 128 and 130 that are typically stitched to the casings.

As described hereinabove with respect to the embodiment of FIGS. 1 and 2, compressible members 112 and 114 are preferably made of a polymeric foam material and more preferably of a polymeric closed cell foam material. Compressible members may be made from cylindrical preforms that are cut longitudinally through center axes 132 and 134 so that compressible members 112 and 114 are semi-cylindrical each with a first, cylindrical, outer surface 136 and 138 and a second, flat or planar, outer surface 140 and 142 contiguous therewith. Compressible members 112 and 114 optionally have longitudinal grooves 144 and 146 in the respective flat surface 140 and 142.

Fastening and user attachment assembly 116 of wearable assist device 110 includes a pair of shoulder straps 148 and 150 each fastened (via adhesive or stitching) to casings or bags 120 and 122. Shoulder straps 148 and 150 hold the assist device 110 and particularly compressible members 112 and 114 in position along the user's back so that the compressible members are parallel to the user's spine and on opposites thereof. Shoulder straps 148 and 150 may be supplemented by a belt or strap attached to casings or bags 120 and 122 so as to be disposable about the torso of the user, exemplarily just below the pectoral muscles or breasts. For instance, fastening and user attachment assembly 116 may be provided with componentry, for instance, a pair of belt segments 152 and 154 having cooperating buckle parts 156 and 158, for suitably fixing the assembly about the torso of the user, with the belt straps buckled to one another across the front of the user's chest. Thus, fastening and user attachment assembly 116 may be configured for positioning and maintaining resiliently compressible members 112 and 114 along the thoracic part of the user's spinal column.

Wearable proprioception assist device 110 further comprises a flexible elongate tensile member 160 such as a bungee cord or stretchable rubber tubing having loops 162 and 164 at opposite ends for coupling the bungee cord to respective hands of the user. Bungee cord 160 extends behind the user's back during use of the device. As shown in FIGS. 3 and 4, bungee cord 160 may slidably traverse an elongate fabric tube 166 attached to casings or bags 120 and 122 (and thus to compressible members 112 and 114) along a front or rear side thereof. Tube 166 may be attached to assembly 118 by glue or stitching. Casings 120 and 122 of fastening and user attachment assembly 116 together with opposite end portions of shoulder straps 148 and 150 and proximal end portions of belt segments 152 and 154 constitute a back side of the user attachment assembly 116, while middle portions of shoulder straps 148 and 150 and distal end portions of belt segments 152 and 154, together with buckle parts 156 and 158 constitute left and right sides and a front side of the user attachment assembly.

Figure 6:
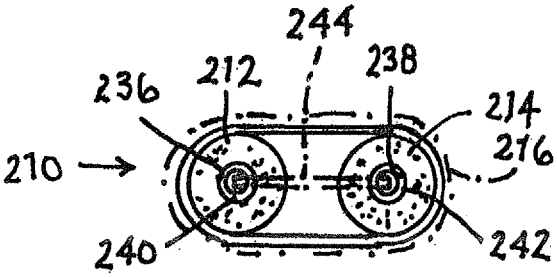
FIG. 6 is a schematic bottom plan view of the device of FIG. 5.
Figure 5:
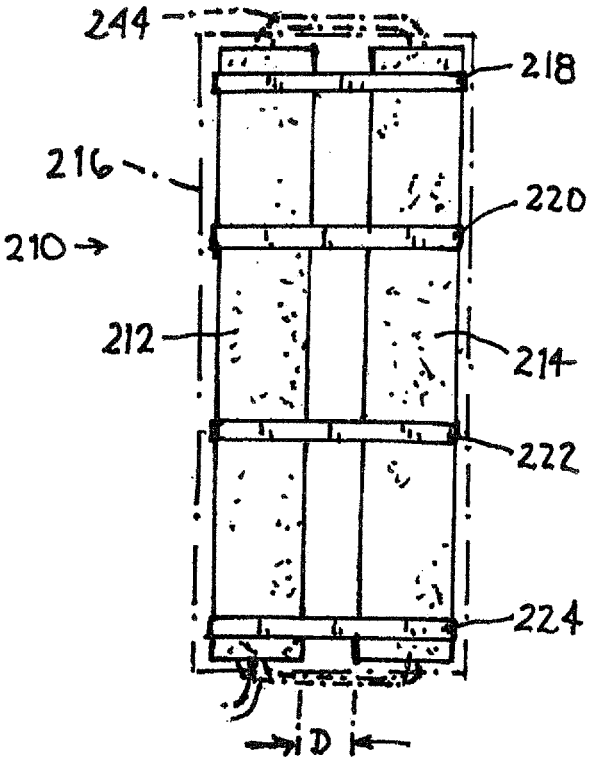
FIG. 5 is a schematic front elevational view of another proprioception assist device in accordance with the present invention, for use in a supine posture.

As illustrated in FIGS. 5 and 6, a proprioception assist device 210 for preferred use during breathing exercises in a supine position of the user (see FIG. 7) comprises a pair of elongate resiliently compressible members 212 and 214 each approximately 40 inches in length. Four coupling elements 218, 220, 222 and 224 in the form of thin flexible bands are attached to and encircle the resiliently compressible members 212 and 214 so as to maintain the resiliently compressible members in parallel relation to one another. Coupling bands 218, 220, 222, and 224 may be attached via adhesive to outer surfaces of the elongate resiliently compressible members 212 and 214.

Members 212 and 214 are cylinders of polymeric foam material with respective center channels or lumens 236 and 238. Optionally, a pair of stiff thermoplastic or polymeric tubes 240 and 242 may be inserted into center channels or lumens 236 and 238, respectively. In addition to or in place of bands 218, 220, 222, and 224, an endless connecting cord 244 may traverse tubes 240 and 242 in a loop to hold compressible members 212 and 214 relative to one another.

Supine proprioception assist device 210 may include a cover or casing 216 made of plastic film or fabric material that encases and holds compressible members 212 and 214. Cover or casing 216 and coupling bands 218, 220, 222, 224 (and/or cord 244) provide compressible members 212 and 214 with a maximum spacing or distance D. That distance is preferably about ¼ inch.

Figure 8:
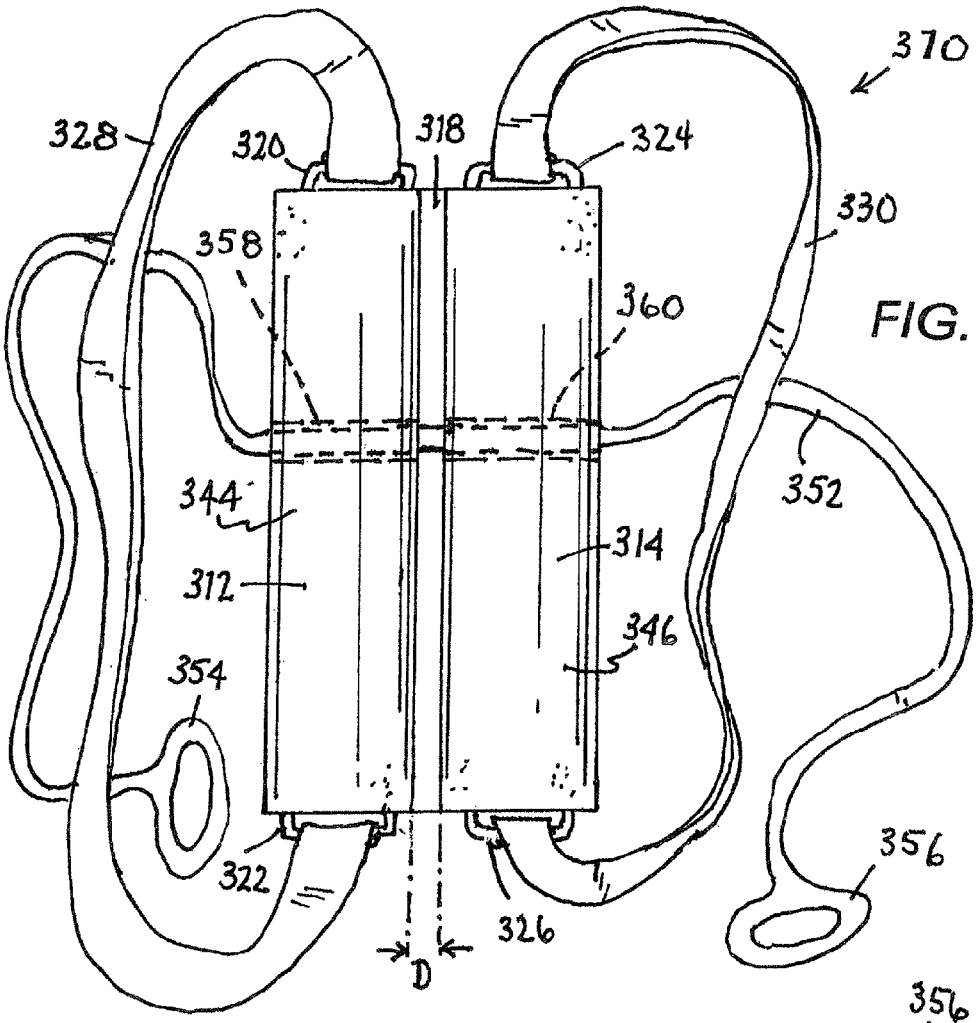
FIG. 8 is a schematic front elevational view of yet another wearable proprioception assist device in accordance with the present invention, for use in a sitting posture.
Figure 9:
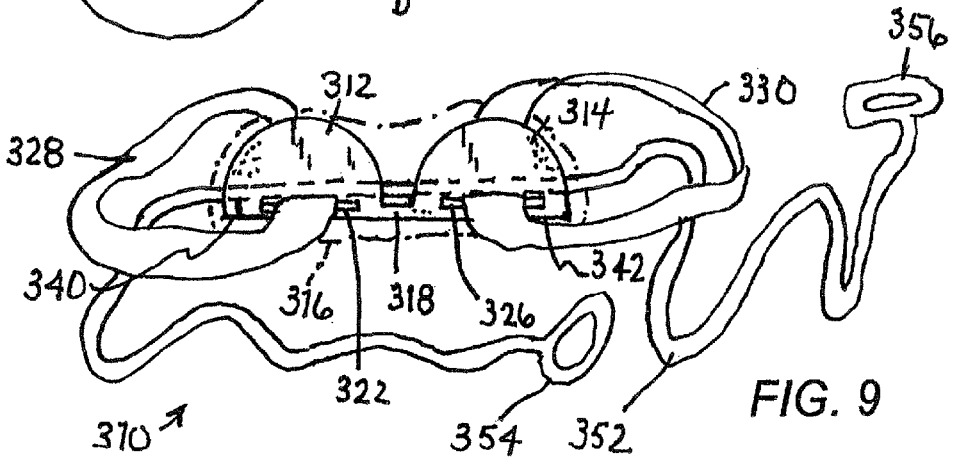
FIG. 9 is a schematic bottom plan view of the wearable device of FIG. 8.

As illustrated in FIGS. 8 and 9, a further wearable proprioception assist device 310 for preferred use during breathing exercises in a sitting position comprises a pair of elongate semi-cylindrical resiliently compressible members 312 and 314 each approximately 7 inches in length. Compressible members 312 and 314 are preferably made of a foam material and more preferably of a closed cell foam material. One or more coupling elements 318 in the form of flattened strips or flanges or webs are attached to the resiliently compressible members 312 and 314 along flat sides 340, 342 thereof so as to maintain the resiliently compressible members in parallel relation to one another and at a substantially fixed spacing or separation (about ¼ inch). Coupling web(s) 318 may be attached via adhesive to flat outer surfaces 340, 342 of the elongate resiliently compressible members 312 and 314, opposite convex or cylindrical surfaces 344 and 346 thereof. Alternatively, compressible members 312 and 314 and web(s) 318 may be integrally molded as a unitary object.

Compressible members 312 and 314 are each provided at respective opposing ends with loops or eyelets 320, 322 and 324, 326 for attachment, to the compressible members, of a user attachment assembly in the form of two shoulder straps 328 and 330. Straps 328, 330 may be elastic strips or non-elastic belts. If straps 328, 330 are made of inelastic material such as fabric, buckles (not shown) may be attached to the straps for adjusting the lengths thereof.

Wearable proprioception assist device 310 optionally includes a cover or casing 316 made of plastic film or fabric material that encases and holds compressible members 312 and 314. Straps 328, 330 pass through slits in the cover or casing 316.

An elongate tensile member 352 such as a bungee cord or stretchable rubber tubing is coupled to compressible members 312, 314 and extends behind the user during use of the device. Bungee cord 352 has loops 354 and 356 at opposite ends for coupling the bungee cord to respective hands of the user. Bungee cord 352 slidably traverses channels 358, 360 in compressible members 312 and 314.

Coupling web 318 (assuming one such connector strip) (and optionally casing 316) provides compressible members 212 and 214 with a maximum spacing or distance D. Coupling web 318 has a width to define distance D between members 312 and 314 of no more than about ¼ inch. Compressible members 312 and 314 is typically manufactured by casting or molding polymeric foam material, without use of a preform. Web connector 318 may be integrally molded together with compressible members 312 and 314. Eyelets or loops, 320, 322, 324, 326 are anchored in the foam material of compressible members 312 and 314 and embedded therein during the molding process. Channels 358 and 360 may be bored by high speed drills after curing of the foam material.

In general, use of a proprioception assist device 10, 110, 210, 310, 502 (FIGS. 19 and 20) as described herein entails placing resiliently compressible members 12, 14; 112, 114; 312, 314; 212, 214; 504, 506; etc., against a back BCK or a user USR (FIG. 7), so that the resiliently compressible members are disposed in parallel to the user's spine and on opposite sides of the spine. Where the compressible members 12, 14; 112, 114; 312, 314; 212, 214; 504, 506; etc., have a convex surface and a flat surface, the convex surface is placed against the user's back while the flat side engages a flat support surface, such as a seat back.

In use of a wearable device 10, 110, 310, the user sits at a desk hunched over a computer and once an hour leans back against the compressible tubes 12, 14; 112, 114; 312, 314; and breathes and pulls the hand held bungees 52, 160, 352 forward to intensify the effect of stimulating the parasympathetic nervous system and release back tension.

Figure 7:
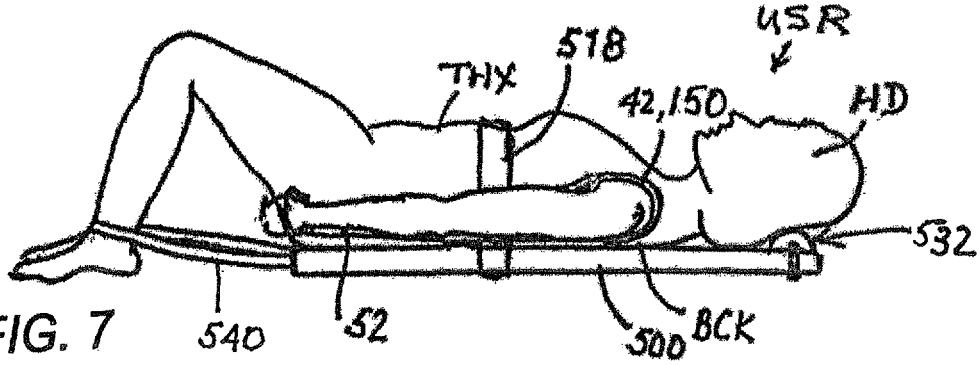
FIG. 7 is a schematic side elevational view showing use of a supine version of a proprioception assist device by a user.
Figure 19:
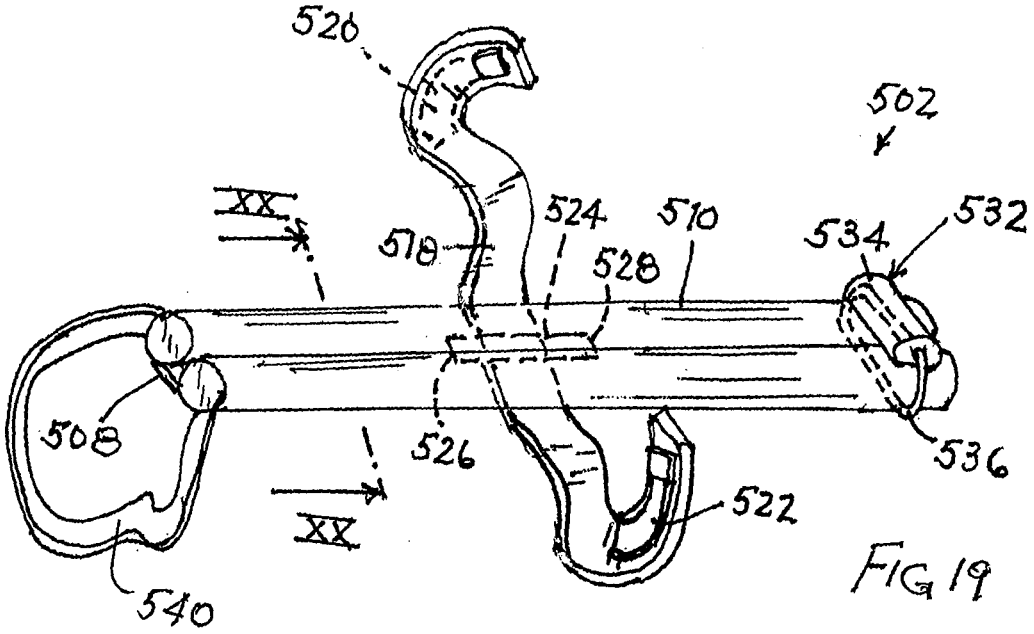
FIG. 19 is a schematic perspective view of an additional proprioception assist device in accordance with the present invention, for use in a supine posture (see FIG. 7).
Figure 20:
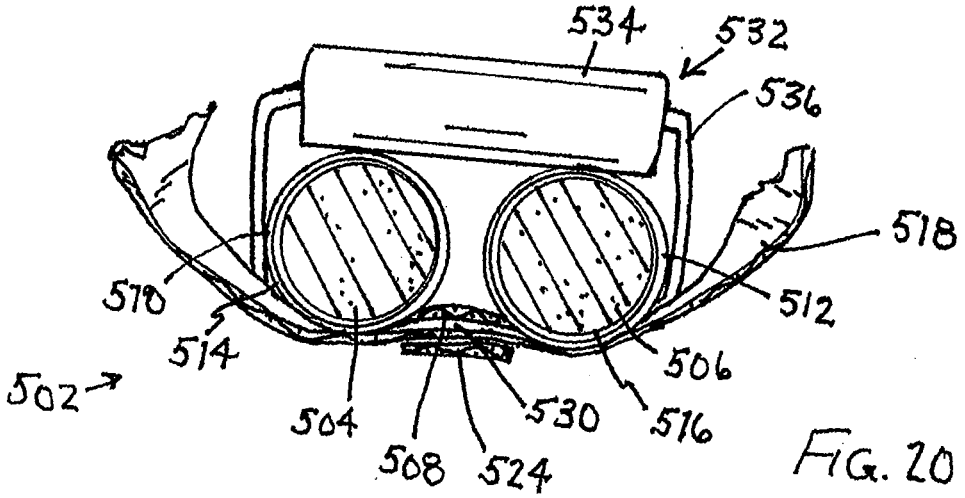
FIG. 20 is a transverse cross-sectional view taken along plane XX-XX in FIG. 19.

FIG. 7 particularly illustrates the use of a supine proprioception assist device 210 or 502 (FIGS. 19 and 20). The USR is in a supine position and a generic compressible member 500 (about 40 inches long) is disposed against the user's back BCK. The user USR breathes into her or his back against the resiliently compressible members 212, 214 or 504, 506 so that the those members exert a traction like action on muscular tissues along the user's spine, providing proprioceptive feedback enhancing the user's respiration. Typically, the movement is a natural by-product of breathing exercises whereby the chest is alternately expanded and contracted, with the contact of the compressible members 212, 214; 504, 506 against the tissues flanking the spine providing the user USR with proprioceptive feedback.

Where a fastening and user attachment assembly 16 or 116 is coupled to the resiliently compressible members 12, 14 or 112, 114, the disposing of the resiliently compressible members against the user's back includes attaching the fastening and user attachment assembly 16 or 116 about the user's rib cage or thorax THX. Where the fastening and user attachment assembly 16, 116 includes an elongate tensile member 52, 160, the attaching of the fastening and user attachment assembly to the user's thorax THX includes disposing the tensile member 52, 160 along the back side of the user USR. The method then further comprises attaching ends (54, 56; 162,164) of the tensile member 52, 160 to the user's hands HND and exerting tension on the elongate tensile member.

A proprioception assist device 502 shown in FIGS. 19 and 20 is particularly adapted for supine use and comprises two elongate resiliently compressible members 504 and 506 each approximately 40 inches in length and at least one coupling element such as a fabric strip 508 connected along longitudinal edges to a pair of casings 510 and 512 that contain compressible members 504 and 506, respectively. Casings 510 and 512 together with coupling strip 508 hold compressible members 504 and 506 in parallel relation to one another and at a maximum distance from one another. The maximum spacing is preferably no more than approximately ¼ inch (between the closest surfaces of the compressible members) so that members 504 and 506 (and casings 510, 512) engage the user over the ribs but not on the shoulder blades.

Compressible members 504 and 506 are preferably made of a polymeric foam material such as polyethylene (PE) or EVA foam and have at least partially cylindrical outer surfaces 514 and 516. Proprioception assist device 502 further comprises a user attachment component in the form of a belt or strap 518 that may be provided with VELCRO type hook and loop fasteners 520 and 522 for securing the belt or strap tightly about a user's rib cage, preferably just south of the pectoral muscles or breasts. Belt or strap 518 is loosely and adjustably coupled to compressible members 504 and 506 via a strip 524 that is sewn or glued at its ends 526 and 528 to coupling strip 508 to form a passageway 530 traversed by belt or strap 518. Belt or strap 518 extends behind the user during use of the device. The longitudinal position of belt or strap 518 relative to compressible members 504 and 506 may be adjusted to suit individual users by sliding the belt orthogonally relative to strips 524 and 508. Strip 524 has a length sufficient to accommodate users of all sizes.

Proprioception assist device 502 further comprises a head support/rest assembly 532 at one end of compressible members 504 and 506 for enabling or facilitating a user's pressing downward of the head HD (FIG. 7) to provide for spinal traction and an enhancement of proprioception awareness. Head support 532 includes a resiliently compressible member 534 attached to compressible members 504 and 506 via an elastic loop or band 536 which is sewn or glued or otherwise attached to casings 510 and 512. Compressible member 534 may be a segment of the same material as compressible elements 504 and 506 and covered in neoprene or another stretchy "warming" fabric. Compressible member 534 is positioned laterally to and in contact with curved or arcuate sidewall surfaces compressible members 504 and 506. Compressible member 534 extends across and to the side of compressible members 504 and 506 at one end thereof.

User USR of a supine device 210 or 502 lies on rollers or compressible members 212, 214 or 504, 506 and breathes into the rib wrap 518 while depressing the head rest 532 and pushing against an ankle restraint 540 to stimulate the parasympathetic nervous system and reduce cortisol (a hormone which prevents weight loss). This process will take approximately five minutes per day. The user USR may take his or her feet out of the restraint 540 and lengthen the legs one at a time and lift the arms overhead. Use of ankle restraint 540 intensifies the traction effect. Ankle restraint 540 may take the simple form of a loop that is connected to an end of device 502 opposite head support 532 and long enough to extends to the feet.

As shown in FIGS. 10-15, proprioception assist device 310 may comprise a body member 402 which includes elongate semi-cylindrical resiliently compressible members 312 and 314 connected to one another via strip or flange 318. Compressible members 312 and 314 are formed with respective planar through slots 404 and 406 which receive elongate flat inserts 408 (FIG. 16-18). Inserts 408 are formed at opposite ends with eyelets or loops 410 and 412 that serve as eyelets or loops 320, 322, 324, 326 shown in FIGS. 8 and 9.

At one end—at the lower left in FIG. 10—through slots 404 and 406 have mouths or openings 414, 416 that are of the same cross-section as the major extent of slots 404 and 406. At an opposite end—upper right in FIG. 10, through slots 404 and 406 are defined by beveled shoulders 418, 420 which result in mouths or openings 422 and 424 of reduced width. As shown in FIGS. 16-18, eyelet or loop 412 of each insert or plate 408 is separated from the body of the insert or plate by a pair of notches 426, 428 that receive beveled shoulders 418 or 420 to lock the respective eyelet-bearing insert 408 to the respective compressible members 312, 314.

Although the invention has been described in terms of particular embodiments and applications, one of ordinary skill in the art, in light of this teaching, can generate additional embodiments and modifications without departing from the spirit of or exceeding the scope of the claimed invention. For instance, a "user attachment component" as that term is used herein may take any form that enables attachment of the feedback assist device to a user so that the elongate resiliently compressible members are maintained in substantial or approximate parallel relation to one another on opposite sides of the user's spine when the device is placed against the user's back and as the user engages in motion of the back in part against a restoring force exerted by the compressible members 12, 14 or 112, 114 or 212, 214 or 312, 314. A user attachment component in a wearable version of the assist device may therefore take the form of a vest, or halter top, with appropriate reinforcement such as leather or canvas bands, to accommodate the stresses exerted by the flexible elastic members during an exercise routine.

Where the user attachment component consists mainly of shoulder straps such as straps 40, 42; 148, 150; 328, 330, those straps may be attached to the resiliently compressible members 12, 14; 112, 114; 312, 314 in any suitable way. For instance, the straps may cross one another. Each strap may be connected at one end to a top of one compressible member and at an opposite end to the bottom of the other compressible member. In the embodiment of FIGS. 5 and 6, shoulder straps may be provided where the straps pass through tubes 240, 241, each strap extending from the top of one compressible member 212 or 214 to the bottom of the other compressible member 214 or 212. In that case, one length of strap may extend through both tubes 240 and 242 and form the two shoulder straps. The straps may be provided with elastic sections or adjustable buckles for optimal fit.

In addition, the device 210 of FIGS. 5 and 6 may be provided with straps, cords or tubing (not shown) acting as shoulder straps.

Compressible members 12, 14; 112, 114; 212, 214; 312, 314 have such a length that the device extends over at least part of the thoracic and optionally part of the lumbar and/or cervical regions of the spine. Preferably, however, where the user USR of the device has to assume a supine posture (FIG. 7), compressible members 12, 14; 112, 114; 212, 214; 312, 314 preferably have a length of about 40 inches so that the device extends from the head down to the tailbone of the user. The distance between the middle of the skull, at a point somewhat above the ears, and the tail bone, is approximately 38-40 inches for the large majority of adults.

Instead of a semi-cylindrical cross-section, compressible members 12, 14; 112, 114; and 312, 314 may have a cylindrical cross-section, like the compressible members 212, 214 shown in FIGS. 5 and 6. The various proprioceptive feedback devices disclosed herein, for instance, devices 10 and 210, may be provided with spacers or buffer elements between the respective compressible members 12, 14 and 212, 214 to ensure a minimum spacing between the compressible members.

Proprioception assist device 10 may also include dual chambers that receive the resiliently compressible members 12 and 14, for purposes of housing the spinous processes.

Accordingly, it is to be understood that the drawings and descriptions herein are proffered by way of example to facilitate comprehension of the invention and should not be construed to limit the scope thereof.

What is claimed is:

1. A device for facilitating or enhancing proprioceptive feedback, comprising:

two elongate resiliently compressible members made of polymeric foam material and so coupled to one another as to maintain a mutually parallel configuration;

at least one fastening or coupling element attached to said two elongate resiliently compressible members and configured for attachment to a user so that said two elongate resiliently compressible members are held against the user's back parallel to the user's spine and on opposite sides thereof; and a third compressible member positioned laterally to and in contact with sidewall surfaces of said two elongate resiliently compressible members, said third compressible member extending across and to the side of said two elongate resiliently compressible members at one end thereof.

2. The device defined in claim 1, further comprising at least one casing or cover different from said at least one fastening or coupling element and enclosing at least one of said two elongate resiliently compressible members.

3. The device defined in claim 2 wherein said at least one casing or covering is one of two separate casings or coverings each enclosing and containing a respective one of said two elongate resiliently compressible members.

4. The device defined in claim 1 wherein said at least one fastening or coupling element is taken from the group consisting of a pair of shoulder straps and a strap or band attached to said two elongate resiliently compressible members so as to be disposable about a rib cage and below breasts or pectoral muscles of the user.

5. The device defined in claim 1, wherein said third compressible member is positioned in contact with curved or arcuate sidewall surfaces of said two elongate resiliently compressible members.

6. A personal exercising method, comprising:

providing a device including two elongate resiliently compressible members made of polymeric foam material and coupled to one another so as to maintain a mutually parallel configuration, the device further including a third compressible member positioned laterally to and in contact with sidewall surfaces of said two elongate resiliently compressible members, said third compressible member extending across said two elongate resiliently compressible members at one end thereof;

disposing said two elongate resiliently compressible members against a user's back, so that said two elongate resiliently compressible members are disposed in parallel to the user's spine and on opposite sides of the spine;

attaching said two elongate resiliently compressible members to the user; and moving at least a portion of the user while the user's back is disposed against said two elongate resiliently compressible members, further comprising placing a back side of the user's head against said third compressible member and pressing the user's head against said third compressible member during the moving of the portion of the user.

7. The method defined in claim 6 wherein the attaching of said two elongate resiliently compressible members to the user includes manipulating a fastening or coupling element taken from the group consisting of shoulder straps and a strap or band extendable about the user's torso.

8. The method defined in claim 6 wherein said fastening or coupling element includes at least one elongate band or strap coupled to said two elongate resiliently compressible members, the attaching of said fastening or coupling element to the user including wrapping said band or strap about the rib cage below breasts or pectoral muscles of the user.

* * * * *